US009857131B1

(12) United States Patent
Rose

(10) Patent No.: US 9,857,131 B1
(45) Date of Patent: Jan. 2, 2018

(54) AMMUNITION INDICATOR SYSTEMS, DEVICES, AND METHODS

(71) Applicant: John M. Rose, Killen, AL (US)

(72) Inventor: John M. Rose, Killen, AL (US)

(73) Assignee: John M. Rose, Killen, AL (US)

( * ) Notice: Subject to any disclaimer, the term of this patent is extended or adjusted under 35 U.S.C. 154(b) by 0 days.

(21) Appl. No.: 15/199,259

(22) Filed: Jun. 30, 2016

(51) Int. Cl.
*F41A 9/62* (2006.01)
*F41A 9/65* (2006.01)

(52) U.S. Cl.
CPC . *F41A 9/62* (2013.01); *F41A 9/65* (2013.01)

(58) Field of Classification Search
CPC ..... F41A 9/62–9/65; F41A 9/73–9/75
USPC ..... 89/197; 42/1.02, 1.01
See application file for complete search history.

(56) References Cited

U.S. PATENT DOCUMENTS 2,828,568 A * 4/1958 Sakewitz ..... F41A 9/62 42/1.02
4,109,401 A * 8/1978 Musgrave ..... F41A 9/62 42/1.01
4,586,281 A * 5/1986 Chesnut ..... F41A 9/65 42/50
5,052,138 A 10/1991 Crain
5,206,444 A * 4/1993 Oliver ..... F41A 9/62 42/1.02
5,291,679 A 3/1994 Wollack et al.
5,642,581 A 7/1997 Herold et al.
5,735,070 A 4/1998 Vasquez et al.
5,799,432 A 9/1998 Wright, Sr. et al.
5,826,360 A 10/1998 Herold et al.
6,094,850 A * 8/2000 Villani ..... F41A 9/62 42/1.02
7,661,217 B2 2/2010 Pikielny
7,730,654 B2 * 6/2010 Kim ..... F41A 9/62 42/1.02
8,186,086 B2 5/2012 Gur-Ari et al.
8,191,297 B2 6/2012 Gwillim, Jr.
8,713,835 B1 * 5/2014 Calvert ..... F41A 9/71 42/49.01

(Continued)

FOREIGN PATENT DOCUMENTS

WO WO2012005829 1/2012

OTHER PUBLICATIONS

RADETEC, AmmoControl Digital Counter, https://radetecusa.com/products/digital-counter/beretta-92fs/, 2016, 3 pages, World Wide Web.

*Primary Examiner* — John Cooper
(74) *Attorney, Agent, or Firm* — Lanier Ford Shaver & Payne PC

(57) ABSTRACT

An ammunition indicator system of the present disclosure uses a magazine configured for housing bullet cartridges, the magazine comprising an outward-facing surface and a cavity. The system further has a follower that fits within the cavity and interfaces with the bullet cartridges inside the cavity. The follower further moves in a direction toward an open end of the magazine as bullet cartridges from the cavity are spent. The system further has a channel in the outward-facing surface of the magazine and an ammunition indicator rod configured for slidably coupling to the channel and fixedly coupling to the follower, the ammunition indicator rod indicates an amount of ammunition in the magazine.

8 Claims, 4 Drawing Sheets

(56) References Cited

U.S. PATENT DOCUMENTS

| | | | | |
|---|---|---|---|---|
| 8,752,317 | B1 * | 6/2014 | Calvert | F41A 9/71<br>42/49.02 |
| 2011/0078936 | A1 * | 4/2011 | Gates | F41A 9/62<br>42/1.02 |
| 2015/0259100 | A1 * | 9/2015 | Boisseau | B65D 25/56<br>42/50 |

* cited by examiner

AMMUNITION INDICATOR SYSTEMS, DEVICES, AND METHODS

BACKGROUND OF THE INVENTION

There are hundreds of different assault rifles readily made and available in most industrially advanced regions of the world. A typical assault rifle uses an intermediate cartridge and a detachable magazine. Further, it is automatic or semi-automatic. An automatic assault rifle is designed such that it fires continually until the trigger is released. Whereas, a semi-automatic assault rifle fires only once when the trigger is pulled.

One such assault rifle is an AK-47. Historically, it gave birth to many variants, which include, for example, AK-15s. Most of the assault rifles in this family of weapons comprise an arch-shaped detachable magazine that contains ammunition, i.e., a bullet cartridge. A carrier inside the rifle moves in a forward direction lengthwise of the rifle, and it loads a bullet cartridge in a barrel of the gun. The trigger is pulled by a gunman, and the bullet cartridge is initiated, i.e., the bullet cartridge is fired. The carrier moves backward, ejecting the spent cartridge, then forward again to load another bullet cartridge.

BRIEF DESCRIPTION OF THE DRAWINGS

The present disclosure can be better understood with reference to the following drawings. The elements of the drawings are not necessarily to scale relative to each other, emphasis instead being placed upon clearly illustrating the principles of the disclosure.

DETAILED DESCRIPTION

The present disclosure is directed to rifles. In particularly, a rifle in accordance with an embodiment of the present disclosure may be automatic, semi-automatic, or any type of rifle having a magazine of bullet cartridges that are spent during firing of the rifle. The rifle of the present disclosure has a magazine from which an ammunition indicator rod protrudes. As bullet cartridges are spent when the rifle is fired, the indicator rod moves. In one embodiment, the ammunition indicator rod is oriented such that it moves upward toward a gunman's line of sight. Thus, when the magazine has been fully emptied of bullet cartridges, the ammunition indicator rod is in the line of sight of the gunman such that the gunman can conclude that most, if not all, ammunition is spent. This conclusion may be made by the gunman without the gunman having to turn the gun to look at the magazine to determine if he needs an additional magazine.

Figure 1:
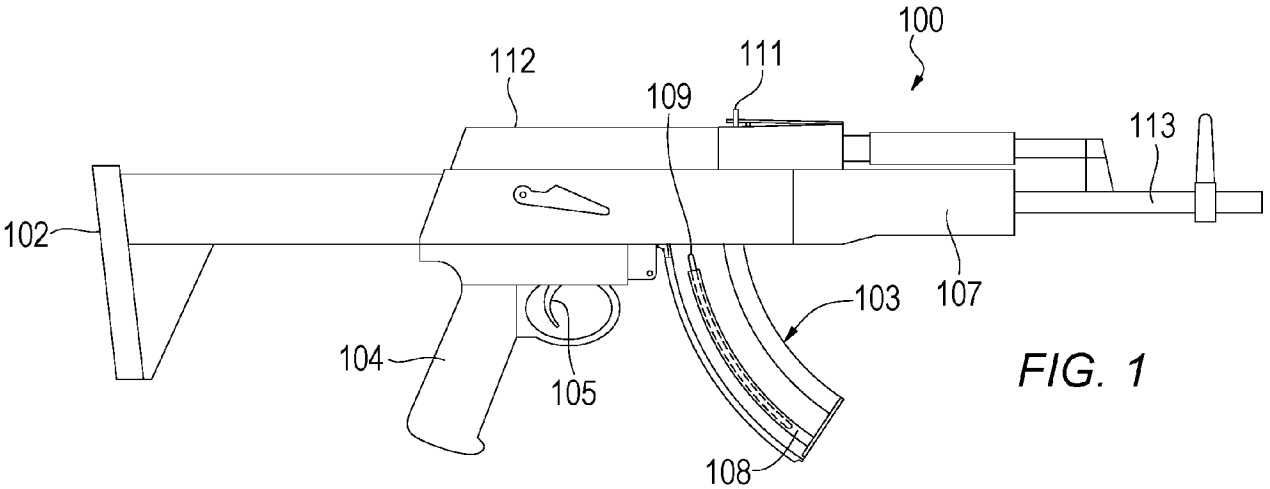
FIG. 1 is a side elevational view of a rifle in accordance with an embodiment of the present disclosure having an ammunition indicator rod that signals to a gunman using the rifle that a magazine loaded in the rifle has maximum ammunition capacity.

FIG. 1 is a side elevational view of a rifle 100 in accordance with an embodiment of the present disclosure. The rifle 100 is any type of assault weapon that uses a magazine to feed bullet cartridges to the barrel of the rifle 100. For example, the rifle 100 may be and AK-47 or an AR-15. The present disclosure is not limited to a particular type of assault weapon in other embodiments. The rifle 100 comprises a buttstock 102 coupled to an end of a midsection 112, and it comprises a barrel 113 coupled to the other end of the midsection 112. Further, the rifle 100 comprises a grip 104 for holding the rifle by the gunman and a trigger 105 for initiating firing of the rifle 100.

In the embodiment depicted in FIG. 1, the rifle 100 comprises a gun sight 111. This gun sight may be formed differently and be located at other positions along the rifle 100 in other embodiments. In one embodiment, a scope sight (not shown but shown in FIG. 9) is coupled to the rifle 100.

Operational components that effectuate loading and firing of the rifle 100 are contained within the midsection 112; a detailed explanation of the operational components is unrelated to the present disclosure. Generally, the operational components load a bullet in the barrel 113 from a magazine 103, and upon pulling the trigger 105, the operational components launch a bullet (not shown) and expel an empty bullet cartridge (not shown).

Figure 2:
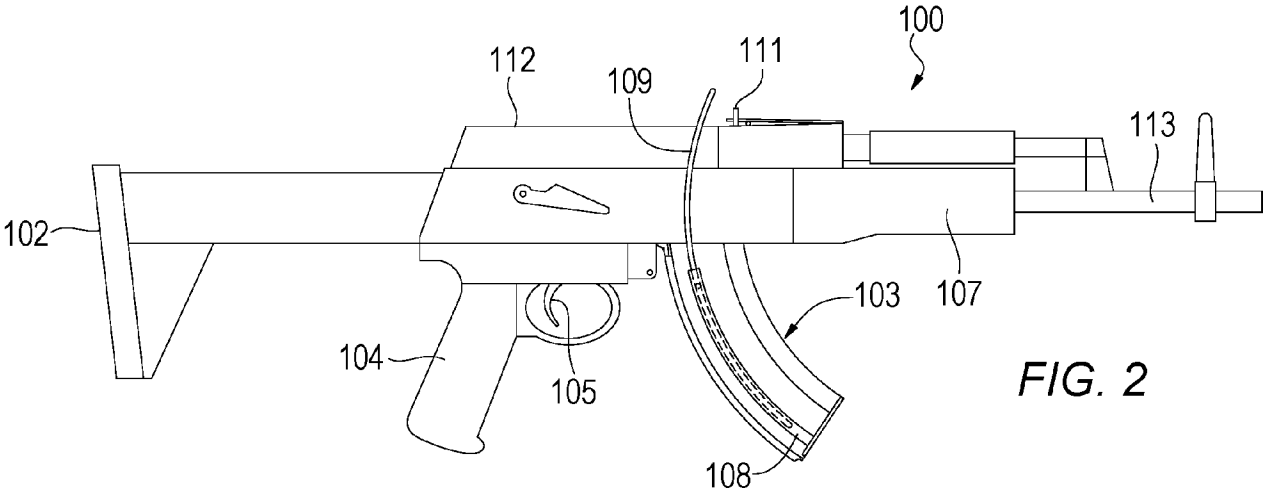
FIG. 2 is the side elevational view of the rifle of FIG. 1, wherein the ammunition indicator rod signals to a gunman using the rifle that the magazine has few, if any, bullet cartridges left in the magazine.

The rifle 100 of the present disclosure comprises the magazine 103 attached thereto, which is shown in FIG. 2 in a contracted stated, i.e., few or no bullet cartridges (shown in FIG. 6) have been loaded from the magazine 103. The magazine 103 contains a plurality of bullet cartridges (not shown) and is configured to store bullet cartridges and feed bullet cartridges to the barrel 113.

Note that the ammunition indicator rod 109 does not extend all the way to the end of channel 108. The channel 108 extends all the way to the end of the magazine 103. This is described further herein with reference to FIGS. 5 and 6.

In one embodiment, the magazine 103 is detachable and is replaceable with a full magazine once the bullet cartridges are spent. In another embodiment, the magazine is integral with the rifle 100. The capacity of the magazine 103 can vary from a few bullet cartridges to 100 bullet cartridges. The size, shape and capacity of the magazine 103 may vary in other embodiments of the present disclosure.

The magazine 103 of the rifle 100 is slidably coupled to an ammunition indicator rod 109. In one embodiment, the slidable ammunition indicator rod 109 is slidably coupled to the magazine 103 via a channel 108 and is fixedly coupled to a magazine follower (not shown). In this regard, as bullet cartridges are loaded and ejected, the follower moves upward toward the midsection 112 of the rifle. Because the ammunition indicator rod 109 is fixedly coupled to the follower, as the follower moves upward toward the rifle midsection 112, the ammunition indicator rod 109 moves with the follower and extends further and further from the channel 108 as the follower moves upward.

When all bullet cartridges contained within the magazine 103 are spent, the follower rests closest to the midsection 112. When the follower is closest to the midsection 112, the ammunition indicator rod 109 extends from the channel 108 a length such that a gunman sees the ammunition indicator rod as is shown in FIG. 2. At the extended position, a gunman (not shown) looking through the site 111 will see the position of the fully extended ammunition indicator rod 109 in his/her peripheral vision. Seeing the fully extended ammunition indicator rod 109 makes the gunman aware that it is about time or is time to load a new magazine 103.

Figure 3:
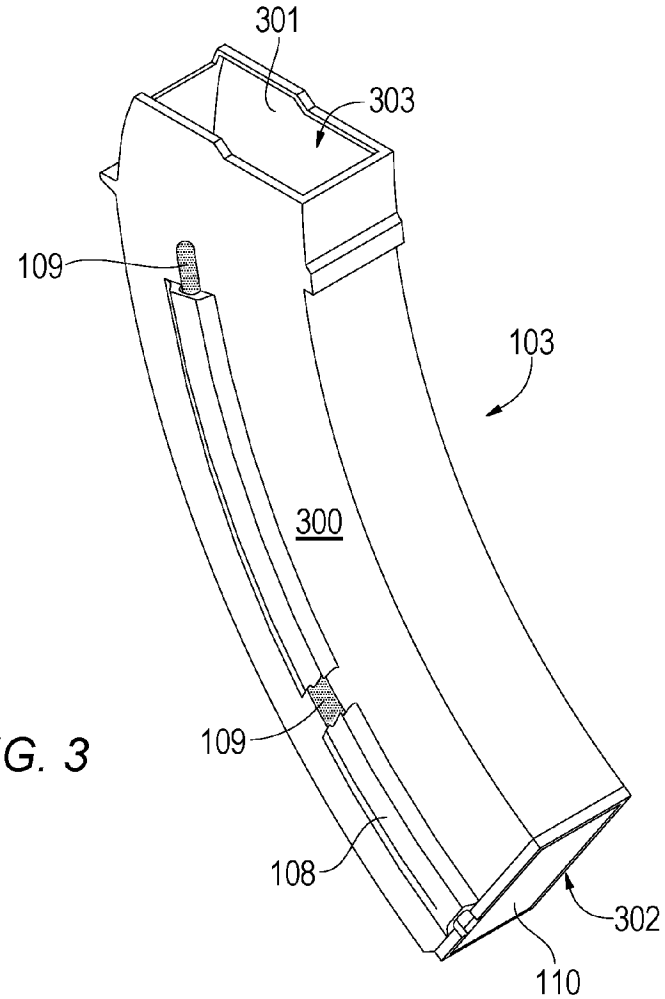
FIG. 3 is perspective view of a magazine used in the rifle that is depicted in FIG. 1.

FIG. 3 is a perspective view of a magazine 103 in accordance with an embodiment of the present disclosure as is shown incorporated in the rifle 100 in FIGS. 1 and 2. The magazine 103 comprises an outward-facing surface 300 and a base plate 110 that closes the magazine 103. Further, the magazine 103 comprises an exposed end 302 that is covered with the base plate 110 and an insertion end 303 through which bullet cartridges are supplied to the barrel 113 (FIG. 1) of the rifle 100 (FIG. 1).

Coupled to the outward-facing surface 300 is a channel 108. Note that the channel 108 is depicted as protruding from the surface 300. However, in other embodiments of the present disclosure, the channel 108 may be flush with the outward-facing surface 300. In one embodiment, the channel 108 is a separate component that is made of a durable material, e.g., hard plastic, and molded onto the outward-facing surface via epoxy. In another embodiment, the channel 108 may be integral with the magazine 103 and not a separate component.

The ammunition indicator rod 109 is slidably contained and slidably coupled within the channel 108. In one embodiment, described further herein, the ammunition indicator rod 109 is coupled to the follower (shown in FIGS. 5 and 6). The follower is initially oriented in proximity to the exposed end 302 of the magazine 103. As bullet cartridges (not shown) are fed to the barrel 113 (FIG. 1) of the rifle 100 (FIG. 1), the follower moves upward in the cavity toward the midsection 112 (FIG. 1) of the rifle. Thus, as ammunition is used by the rifle 100 (FIGS. 1 and 2), the follower moves upward in the arch-shaped cavity 301 of the magazine, and as the follower moves up, the ammunition indicator rod 109 moves upward toward the line of sight of a gunman (not shown).

Note that the magazine 103 is shown as arch-shaped. However, the present disclosure encompasses any type and shape of magazine known in the art or future-developed.

Figure 4A:
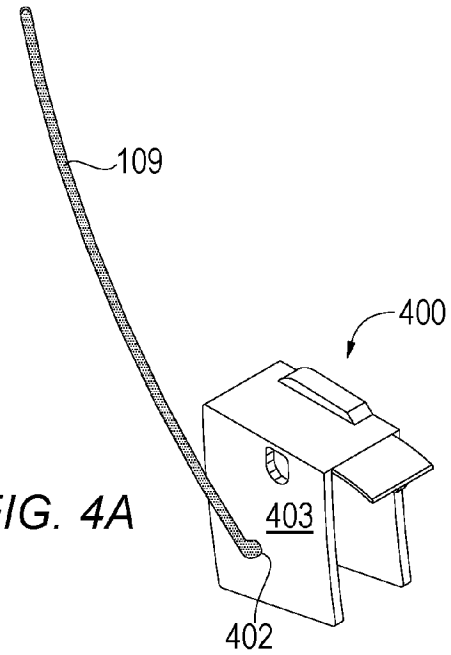
FIG. 4A is a perspective view of follower that has been removed, but in operation is contained in, the magazine that is depicted in FIG. 3.

FIG. 4A is a perspective view of a follower 400 in accordance with an embodiment of the present disclosure. The follower 400 has a cube-shaped housing. It is sized so as to fit within the cavity 301 (FIG. 3). As described hereinabove, the follower 400 is initially positioned in proximity to the exposed end 302 (FIG. 3), and as bullet cartridges 601 are spent, the follower moves toward the insertion end 303 (FIG. 3) of the cavity 301.

The ammunition indicator rod 109 is coupled to an outward-facing surface 403 of the follower 400 so that when the follower 400 is inserted within the magazine 103 (FIG. 3), the ammunition indicator rod 109 extends through the outward-facing surface 300 (FIG. 3), slides through the channel 108 (FIG. 1), and extends past the end of the channel 108 (FIG. 1).

In one embodiment, there is an opening 402, e.g., a round hole, through the outward-facing surface 403. The ammunition indicator rod 109 extends through the opening 402 and epoxy is used to couple the ammunition indicator rod 109 to the follower 400. In another embodiment, the ammunition indicator rod 109 is integral with the housing of the follower 400. These are just exemplary means for coupling the ammunition indicator rod 109 to the follower. Note that there are a number of other ways that the ammunition indicator rod 109 may be coupled to the follower in other embodiments.

Figure 4B:
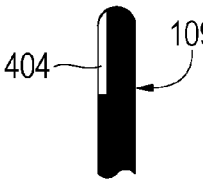
FIG. 4B is a perspective view of the ammunition rod depicted in FIG. 3.

FIG. 4B is a perspective view of a portion of an exemplary ammunition indicator rod 109 in accordance with the present disclosure. Notably, the ammunition indicator rod 109 would be a solid dark color, e.g., black. However, a top portion 404 of the ammunition indicator rod 109 would be a lighter color, e.g., neon. The ammunition indicator rod 109 would be configured such that the portion 404 would be visible to the gunman, i.e., the portion 404 would not extend around the entire circumference of the ammunition indicator rod 109.

Figure 4C:
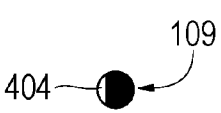
FIG. 4C is a top view of the ammunition rod depicted in FIG. 4B.

FIG. 4C is a top view of the exemplary ammunition indicator rod 109 depicted in FIG. 4B. Notably, the portion 404 does not extend about the circumference of the ammunition indicator rod 109. Thus, it is only visible to the gunman.

Figure 5:
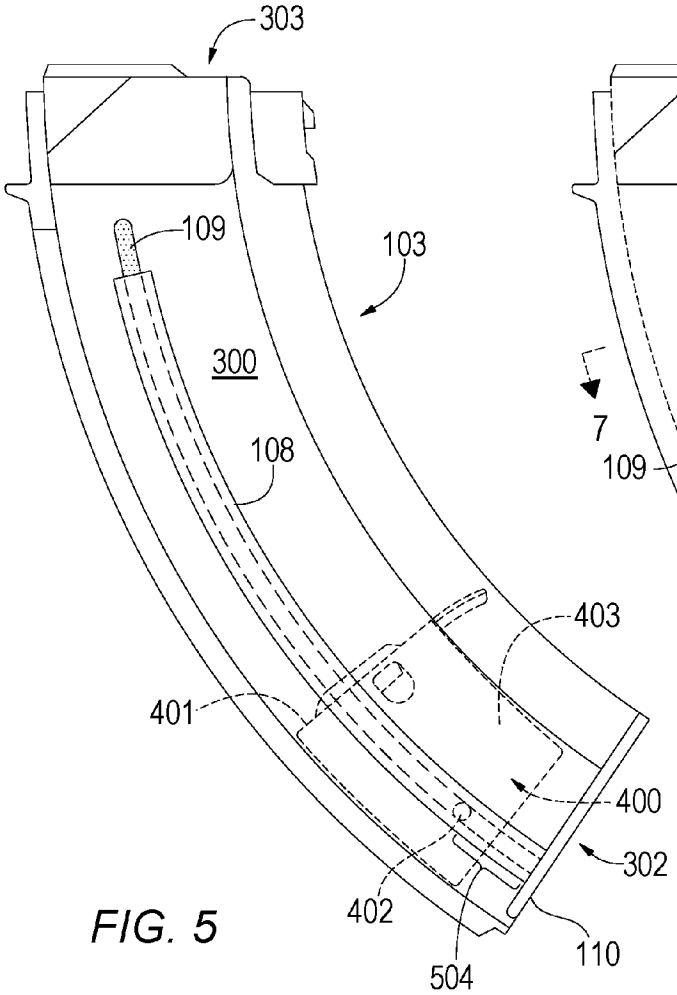
FIG. 5 is a side elevational view of the magazine

FIG. 5 is a side elevational view of the magazine 103. The magazine 103 is full with bullet cartridges (shown in FIG. 6), i.e., not bullet cartridges have yet been fed and loaded into the barrel 113 (FIG. 1).

When the magazine 103 is fully loaded with bullet cartridges, the follower 400 is located in proximity to the exposed end 302 of the magazine 103. Note that the cavity is continuous till the end of the magazine 103. However, the ammunition indicator rod 109 extends through the channel 108 and fits with the opening 402.

An extension 504 of the channel 108 to the exposed end 302 allows for insertion of the ammunition indicator rod 109 into the channel 108 during manufacture. Note that in other embodiments, the channel 108 may not extend to the exposed end 302 of the magazine 103 given that different manufacturing processes may be used to form the magazine 103.

Figure 6:
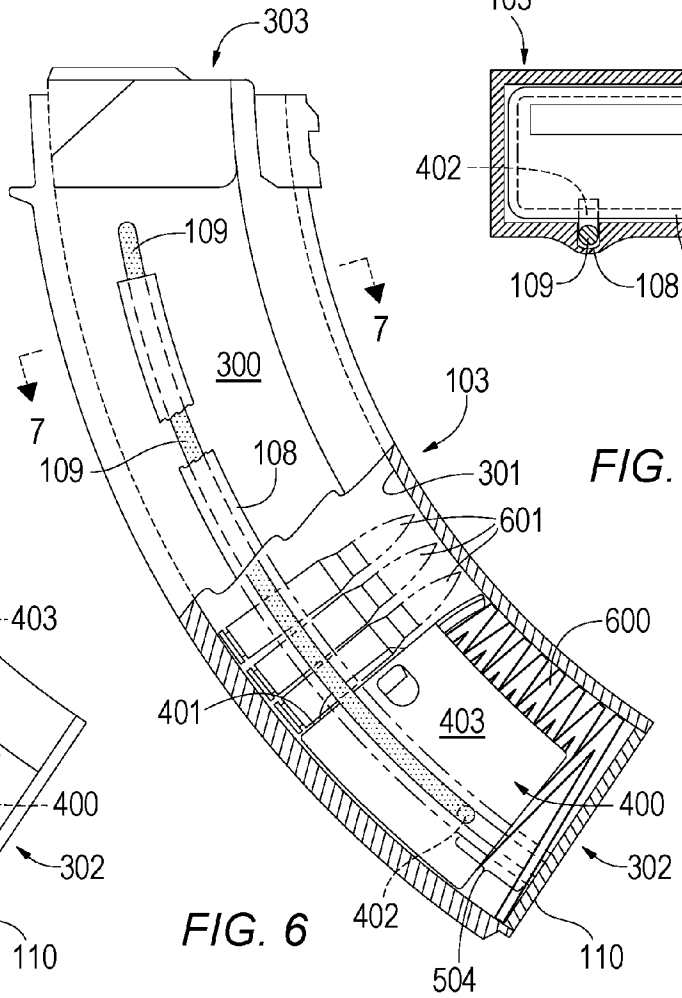
FIG. 6 is a partial sectional view of the magazine depicted in FIG. 3.

FIG. 6 is a partial sectional view of the magazine 103. At the exposed end 302 of the magazine 103 a spring 600 interfaces with the follower 400. In one embodiment, the spring 600 fits with a cavity of the follower 400. As bullet cartridges are fed to and expelled from the barrel 113 (FIG. 1), the spring 600 urges the follower 400 toward the insertion end 303 of the magazine 103. As noted hereinabove and shown again in FIG. 6, the ammunition indicator rod 109 slidably fits within the channel 108.

Further, an end of the ammunition indicator rod 109 fits within opening 402 in the follower 400. In this regard, the end of the ammunition indicator rod 109 may be epoxied to the follower 400 in some embodiments. Other methods may be used to fix the ammunition indicator rod 109 to the follower 400.

As the follower 400 is urged toward the insertion end 303, the follower 400 applies an upward force on the bullet cartridges 601. The urging of the follower 400 on the bullet cartridges 601 places the next bullet cartridge 601 in a position to be loaded into the barrel 113 (FIG. 1).

When all the bullet cartridges 601 have been spent, the follower 400 is located in proximity to the insertion end 303 of the magazine 103. Accordingly, the ammunition indicator rod 109 slides in a direction toward the insertion end 303 then extends above the rifle into the gunman's (not shown) line of sight.

Figure 7:
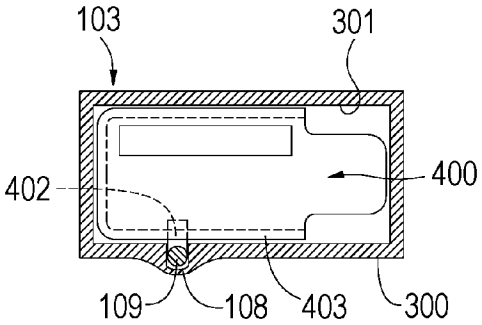
FIG. 7 is a sectional view taken along line 7-7 of FIG. 6 of the magazine depicted in FIG. 3.

FIG. 7 is a sectional view of the magazine 103 taken along line 7-7 in FIG. 6. The magazine comprises the follower 400. Further, the ammunition indicator rod 109 slidably runs through the channel 108 and through opening 402 of the follower 400. In one embodiment, epoxy is used to secure the end of the ammunition indicator rod 109 through the opening 402 and to the follower 400.

Figure 8:
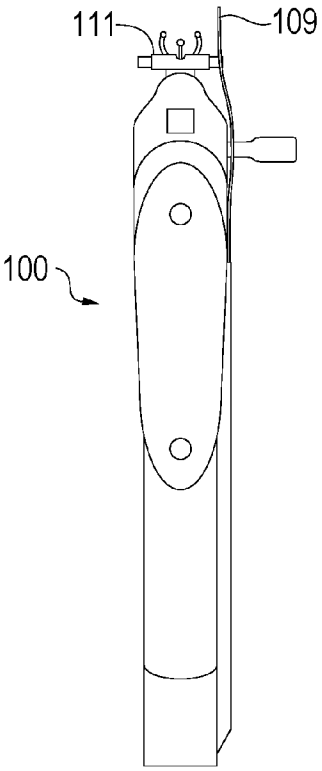
FIG. 8 is a view of a rifle in accordance with an embodiment of the present disclosure having a gun sight and showing the ammunition indicator rod at a position that can be seen by a gunman relative to the gun sight and indicating that the magazine is low on bullet cartridges or empty.

FIG. 8 depicts a view looking down the barrel 113 of the rifle 100 (FIG. 1). The rifle 100 comprises the sight 111. When a gunman is aiming his/her gun to shoot at a target, he/she looks through the sight 111 down the barrel 113.

When the bullet cartridges 601 (FIG. 6) in the magazine 103 (FIG. 3-FIG. 6) are spent, the ammunition indicator rod 109 is positioned as shown in proximity to the sight 111. In this regard, the follower 400 (FIG. 6) urges the ammunition indicator rod 109 upward toward the sight 111 until the bullet cartridges 601 in the magazine 103 are spent. When the bullet cartridges 601 are spent, the ammunition indicator rod 109 is positioned in proximity to the sight 111 and in the line of sight of a gunman (not shown). In this regard, the gunman knows when the magazine 103 is almost empty or completely empty without having to turn the rifle 100 (FIG. 1) towards him to visually inspect the magazine 103.

Figure 9:
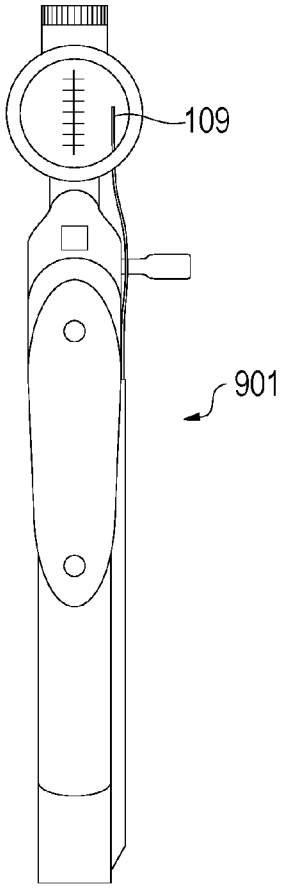
FIG. 9 is a view of a rifle in accordance with an embodiment of the present disclosure having a scope sight and showing the ammunition indicator rod at a position that can be seen by a gunman relative to the scope sight and indicating that the magazine is low on bullet cartridges or empty.

FIG. 9 depicts a view looking down a barrel (not shown) of a rifle 901 on which a scope sight 900 has been secured. When a gunman is aiming his/her gun to shoot at a target, he/she looks through the scope sight 900 down the barrel.

When the bullet cartridges 601 (FIG. 6) in the magazine 103 (FIG. 3-FIG. 6) are spent, the ammunition indicator rod 109 is positioned as shown in proximity to the scope sight 900. In this regard, the follower 400 (FIG. 6) urges the ammunition indicator rod 109 upward toward the scope sight 900 until the bullet cartridges 601 in the magazine 103 are spent. When the bullet cartridges are spent, the ammunition indicator rod 109 is positioned in proximity to the scope sight 900 in the line of sight of the gunman (not shown). In this regard, the gunman knows when the magazine 103 is almost or completely empty without having to turn the rifle 100 (FIG. 1) to visually inspect the magazine 103.

Note that the ammunition rods 109 depicted in FIG. 8 and FIG. 9 are shown to the right of the sight 111 (FIG. 8) and the scope sight 900. The present disclosure also contemplates that the ammunition rods 109 may be to the left of the sight 111 and the scope sight 900 in other embodiments.

What is claimed is:

1. An ammunition indicator system, comprising a magazine configured for housing bullet cartridges, the magazine comprising an outward-facing surface and a cavity;

a follower configured to fit within the cavity and to interface with the bullet cartridges inside the cavity, the follower further configured to move in a direction toward an insertion end of the magazine as bullet cartridges from the cavity are spent;

a vertical channel configured in the outward-facing surface of the magazine that extends from a bottom surface of the magazine to the insertion end of the magazine; and an ammunition indicator rod configured for slidably coupling to the channel and fixedly coupling to the follower, the ammunition indicator rod further configured for extending above the insertion end of the magazine and above a midsection of a firearm as bullet cartridges are spent and the follower urges the rod in the direction of the midsection of the firearm.

2. The system of claim 1, wherein the magazine is arch-shaped.

3. The system of claim 1, wherein the channel is raised relative to the outward-facing surface of the magazine.

4. The system of claim 1, wherein the channel is flush with the outward-facing surface of the magazine.

5. The system of claim 1, wherein the channel is configured to extend from a proximity to an insertion end of the magazine and to terminate at an exposed end of the magazine, the channel at the exposed end forming an opening configured to receive the ammunition indicator rod.

6. The system of claim 1, wherein the ammunition indicator rod is configured to move in a generally vertical direction towards a barrel of the firearm when a firearm is in a horizontal firing position.

7. The system of claim 6, wherein the follower is configured to urge the ammunition indicator rod toward the barrel of the firearm as the bullet cartridges are expended from the magazine.

8. The system of claim 1, wherein the ammunition indicator rod comprises a lighter-colored portion positioned in the channel, the lighter-colored portion is lighter relative to the remainder of the ammunition indicator rod.

* * * * *